US005625991A

United States Patent [19]

Sturrus

[11] Patent Number: 5,625,991

[45] Date of Patent: May 6, 1997

[54] MULTIPLE PANEL ASSEMBLY AND CONNECTOR ASSEMBLY THEREFOR

[75] Inventor: Peter Sturrus, Grand Haven, Mich.

[73] Assignee: Shape Corporation, Grand Haven, Mich.

[21] Appl. No.: 475,074

[22] Filed: Jun. 7, 1995

[51] Int. Cl.[6] ..... E04B 2/00

[52] U.S. Cl. ..... 52/584.1; 52/281

[58] Field of Search ..... 52/584.1, 582.1, 52/578, 281; 463/335, 336, 363

[56] References Cited

U.S. PATENT DOCUMENTS

| | | | |
|---|---|---|---|
| Re. 27,215 | 11/1971 | Propst et al. . | |
| 3,430,997 | 3/1969 | Propst et al. . | |
| 3,517,467 | 6/1970 | Propst et al. | 52/239 X |
| 3,927,924 | 12/1975 | Kelley . | |
| 4,375,010 | 2/1983 | Mollenkopf | 160/127 |
| 5,058,347 | 10/1991 | Schuelke et al. | 52/584.1 X |

FOREIGN PATENT DOCUMENTS

| | | | |
|---|---|---|---|
| 1129634 | 1/1957 | France | 52/584.1 |

*Primary Examiner*—Carl D. Friedman
*Assistant Examiner*—Beth A. Aubrey
*Attorney, Agent, or Firm*—Price, Heneveld, Cooper, DeWitt & Litton

[57] ABSTRACT

A multiple panel assembly which is an improvement in the panel assembly of U.S. Pat. No. 3,430,997 in which the four parts of said patent forming the hanger bracket and connector assembly mounted on the opposing edges of two adjacent panel edges is replaced by a unique one-piece hanger bracket/connector strip. Such strip is substantially less costly to manufacture and install on the panel. Within a more narrow aspect of this invention, the wedging members that draw the panel edges toward each other are uniquely configured to accommodate use of the hanger bracket/connector strip with the hanger bracket and connector assembly of U.S. Pat. No. 3,430,997.

11 Claims, 5 Drawing Sheets

MULTIPLE PANEL ASSEMBLY AND CONNECTOR ASSEMBLY THEREFOR

This invention relates to a multiple panel assembly and more particularly, to a panel connector assembly for connecting and locking the opposing edges of two adjacent panel edges together. More particularly, this invention relates to improvement in the panel connector assembly of U.S. Pat. No. 3,430,997, issued on Mar. 4, 1969, and entitled PANEL JOINT.

BACKGROUND OF THE INVENTION

More than 28 years ago, the panel joint of U.S. Pat. No. 3,430,997 was invented and developed and has been manufactured and sold as a major product of the assignee of such patent since that time. Very little, if any, changes have been made by the assignee in manufacture of the panel connector assembly since its inception, despite the fact that the assignee has made and sold many inventions in space divider systems in which a plurality of vertically oriented panels are interlocked at their adjacent edges to be used in what has become known as landscape furniture arrangements.

Throughout this more than 25-year span, there obviously has existed a need for reducing the cost of space divider systems and particularly, the panel connector assemblies for connecting and locking the opposing edges of the panels together. Despite this need, the connector assembly as disclosed in U.S. Pat. No. 3,430,997 has been manufactured with very little changes and sold by the assignee of said patent in great volumes.

Specifically, as disclosed in U.S. Pat. No. 3,430,997, the panel connector assembly for each of the edges of the panels has comprised four parts, including a U-shaped channel first connected to the edge of the panel and a hanger bracket assembly provided with a plurality of aligned slots for receiving clips extending from the jolt of the panels to support many types of accessories. The hanger brackets extend substantially the entire height of the panels and have upper and lower wedging members affixed within the U-shaped channels at the facing edges of the panels. Thus, for each edge of each panel, four distinct, separate parts are required. These parts are not only costly to produce, but also to assembly on the edge of the panels.

SUMMARY OF THE INVENTION

This invention relates to an improvement on the panel connector assembly of U.S. Pat. No. 3,430,997. In accordance with this invention, the four parts mounted on the edge of the panels are replaced by one part that produces the triple function of providing a hanger bracket, wedging means, and flange means for hiding portions of the hanger bracket. All these functions, in accordance with this invention, are accomplished with one hanger bracket/connector strip, thus reducing the cost of three additional parts and simplifying the mounting of the connector to the edges of the panels.

In accordance with this invention, the shape of the hanger bracket is modified so as to provide flanges that eliminate the requirement for the U-shaped channels. The configuration of the hanger bracket is also modified to provide wedging pockets at their upper and lower ends that eliminate the separate wedging members of U.S. Pat. No. 3,430,997. In accordance with this invention, there are two embodiments. One of the embodiments will accommodate the presently utilized upper and lower wedge mating members as described in U.S. Pat. No. 3,430,997. The second embodiment involves a redesign of the upper and lower edge mating members, all of which will be readily understood by reference to the following specification and accompanying figures.

DETAILED DESCRIPTION OF THE PREFERRED EMBODIMENT

Figure 1:
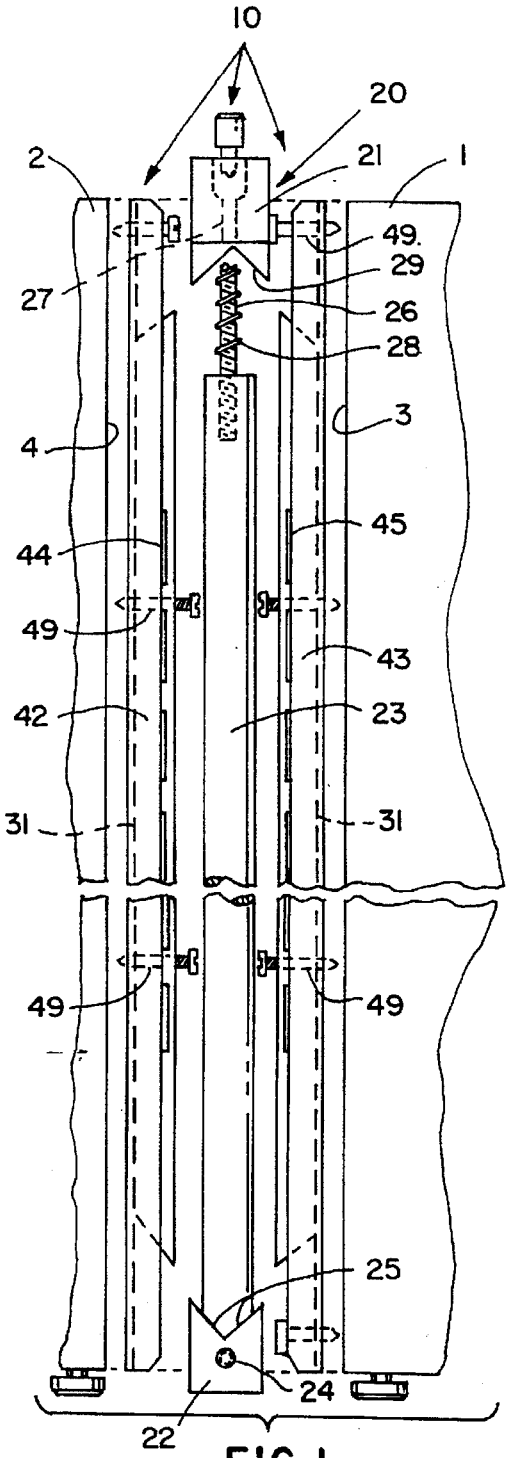
FIG. 1 is an exploded view of the various parts of the panel connector assembly.

Referring to the drawings, FIG. 1 discloses an exploded view of a pair of spaced divider panels 1 and 2 having the upright edges 3 and 4 adapted to be secured together by the hanger bracket/connector assembly 10 which includes the panel interlock assembly 20 comprising an upper wedging draw block 21 and a lower wedging draw block 22 connected together by an elongated tie rod or bar 23. The lower wedging draw block 22 is secured to the tie rod 23 by any conventional means such as a screw or bolt 24. The lower wedging draw block 22 has upwardly directed, generally V-shaped wedging surfaces 25 provided to be received in sockets located at the lower ends of the hanger bracket/connector strips 30 as will be described hereinafter. The upper wedging draw block 21 is adjustably affixed to the upper extremity of the tie bar 23 by means of an elongated screw member 26. The tie rod 23 is preferably fabricated from a piece of metallic tubing tapped at its upper extremity, and the elongated screw member 26 is screwed directly therein. The screw 26 passes through aperture 27 in the upper draw block 21. A compression spring 28 is provided to prevent the upper wedging block 21 from sliding down on bolt 26 so as to assist in the assembly and disassembly of the panel joint as will become apparent. The upper draw block 21 is also provided with generally V-shaped wedging surfaces 29 which are adapted to be received in sockets provided on the hanger/connector strips as will be described hereinafter.

Figure 6:
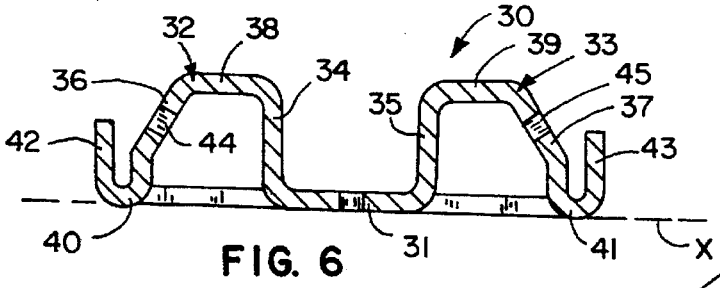
FIG. 6 is a cross-sectional view taken along the plane VI—VI of FIG. 3.

Each hanger bracket/connector strip 30 is formed from a single piece of steel and has a configuration as disclosed in FIGS. 2, 3, 4, and 6. FIG. 6 shows a cross section of the hanger bracket/connector strip 30. It discloses a flat central portion 31 located on the plane X which, when assembled on the edge of a panel, the surface of the panel lies on the same plane X as the flat central portion. U-shaped protruding bent portions 32 and 33 are located on each end of the flat central portion 31 and extend away from the plane X. The U-shaped protruding bent portions 32 and 33 include the inner legs 34 and 35, the outer legs 36 and 37, and the webs or bite portions 38 and 39, respectively. Outer legs 36 and 37 are connected to the reverse bent portions 40 and 41, respectively, and extending from the reverse bent portions 40 and 41 are the flanges 42 and 43, respectively.

The outer legs 36 and 37 include the elongated slots 44 and 45 spaced longitudinally along the strip 30 for receiving accessory hooks so as to support accessories on the panels.

Figure 2:
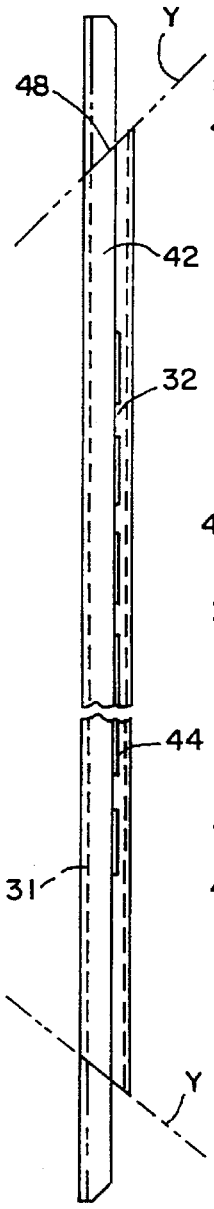
FIG. 2 is a side-elevational view of one embodiment of the novel hanger bracket/connector strip of this invention.
Figure 3:
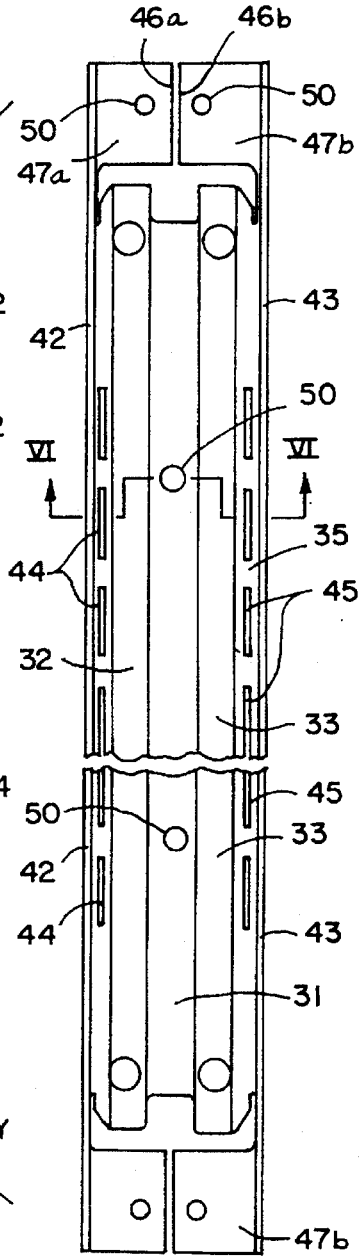
FIG. 3 is a plan view of the novel hanger bracket/connector strip of FIG. 2.

It will be noted from FIGS. 1 and 2 that the flanges 42 and 43 are of a length to slightly overlap the elongated slots 44 and 45, respectively. Thus, the slots are just sufficiently exposed to permit the easy insertion of the accessory hooks while at the same time sufficiently covering the slots when viewed from the front of the panel so as to add to the aesthetic properties of the overall panel system.

Figure 4:
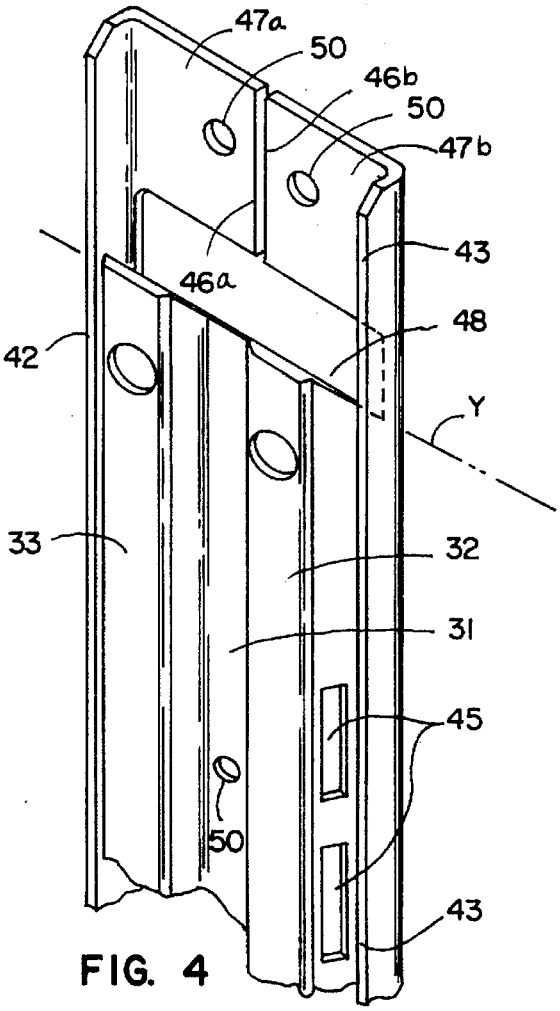
FIG. 4 is a perspective view of an end portion of the hanger bracket/connector strip of FIGS. 2 and 3.

The strip 30 is primarily formed by roll-forming and bending a single sheet of steel. However, at the extreme ends thereof, the U-shaped protruding portions are cut to provide the configuration as disclosed in FIGS. 2, 3, and 4. Specifically, the protruding portions at the very extreme end are cut along the severance lines 46*a* and 46*b* and then flattened to provide the flat surfaces 47*a* and 47*b*. Further, the U-shaped protruding portions are cut along the inclined plane Y (FIGS. 2 and 4). The cuts are made without disturbing the flanges 42 and 43. The cuts provide a socket 48 for receiving the wedging surfaces 25 and 29 of the wedging draw blocks 21 and 22, respectively, it being understood that the upper and lower ends of the strip 30 are identical. Further, the angle of the inclined plane is selected to correspond with the angles of the wedging surfaces 25 and 29 of the draw blocks 21 and 22. The strips 30 are attached to the edges of the panels by screws 49 extending through openings 50.

Figure 5:
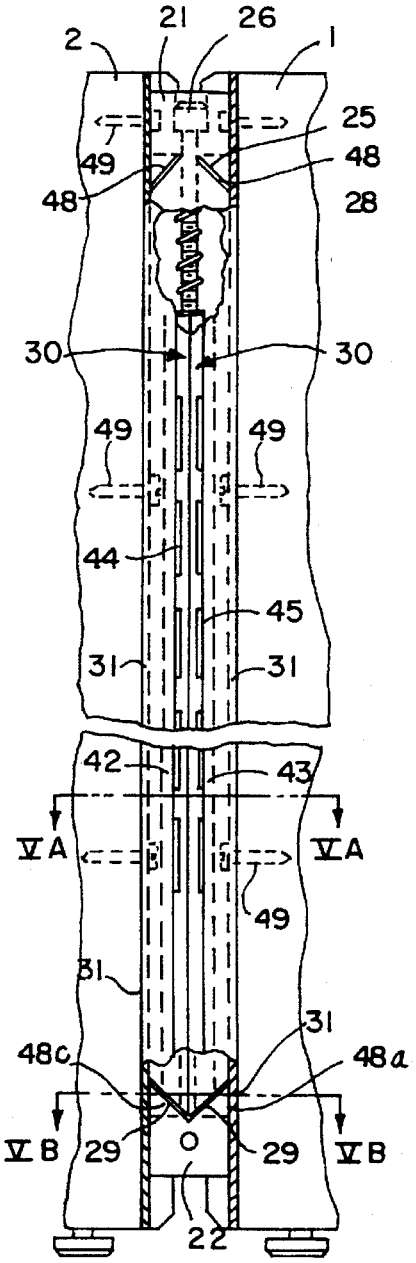
FIG. 5 is a side-elevational view of two panels connected together along their edges by the hanger bracket/connector strips of FIGS. 1–4 and upper and lower wedge mating members with tie rod as disclosed in FIG. 1.
Figure 5A:
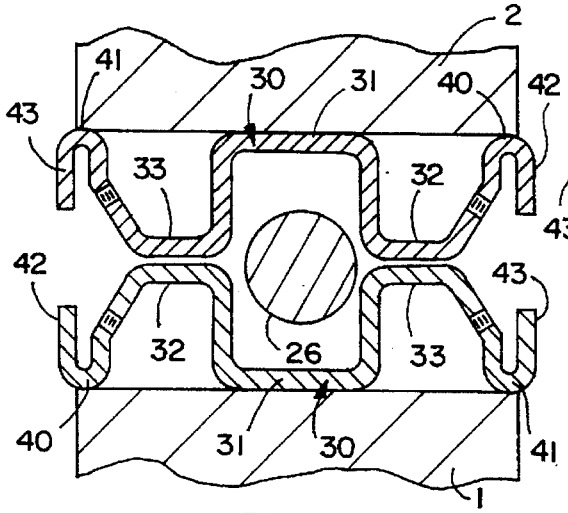
FIG. 5A is a cross-sectional view taken along the plane VA—VA of FIG. 5.

Referring to FIGS. 5 and 5A, they disclose two panels 1 and 2 connected together by the hanger connector assembly including bracket/connector strips 30, one on each of the panels 1 and 2. As disclosed in FIG. 5, the strips are secured to the edges of the panels by screws 49 extending through openings 50 (FIGS. 3 and 4) spaced along the strips from the upper end to the lower end. The connector assembly is located between the two strips 30 with the wedging surfaces 25 of the upper wedging draw block 21 inserted into the pockets 48 of the two strips 30. At the lower end of the panels, the wedging surfaces 29 of the lower wedging draw block 22 is inserted in the sockets 48*c*. As shown, the upper and lower wedging draw blocks 21 and 22 have been drawn toward each other by the tie rod 23 by screwing the screw member in a direction so as to draw the two wedging draw blocks toward each other. As these two wedging draw blocks are drawn toward each other, the wedging surfaces 29 and 25 engaging the inclined surfaces of the U-shaped protruding portions draws the edges of the two panels 1 and 2 toward each other and securely holds them in the position as disclosed in FIG. 5A.

FIGS. 8–12 disclose another embodiment of my invention. In this embodiment, the cross-sectional shape of the strip 30*a* is identical, except at the extreme ends. Therefore, many of the same reference numerals with the suffix "a" will be utilized in the description of this embodiment. Specifically, the U-shaped protruding portions 32*a* and 33*a* are cut square rather than at an inclined angle. Thus, hanger bracket/connector strip 30*a* includes a flat central portion 31*a*, U-shaped protruding portions 32*a* and 33*a* with slots 44*a* and 45*a*, reverse bent portions 40*a* and 41*a*, and flanges 42*a* and 43*a*. The shapes of the U-shaped protruding portions 32*a* and 33*a* are identical to the U-shaped protruding portions 32 and 33 of hanger bracket/connector strip 30. Accordingly, they include inner legs 34*a* and 35*a*, outer legs 36*a* and 37*a*, and webs 38*a* and 39*a*.

Figure 11:
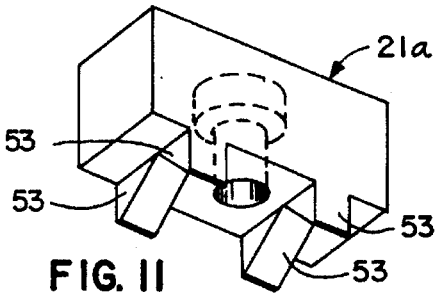
FIG. 11 is a perspective view of one of the wedge mating members utilized with the hanger bracket/connector strip of FIGS. 8, 9, and 10.

In the utilization of strip 30*a*, each strip includes two sockets 51 and 52. Socket 51 is formed between inner leg 34*a* and outer leg 36*a*. Socket 52 is formed between inner leg 35*a* and outer leg 37*a*. In the use of the hanger bracket/connector strip 30*a*, differently shaped upper and lower wedging draw blocks 21*a* and 22*a* are utilized. FIG. 11 discloses the construction and shape of an upper wedging draw block 21*a*. This draw block 21*a* includes four wedging elements 53, two on each side of the block and spaced to be received within sockets 51 and 52 formed between the legs of the U-shaped protruding portions 32*a* and 33*a*. The lower draw block (FIG. 12) is substantially identical in shape except for the connection of the block to the tie rod bar 23 which is identical to the connection between the tie rod 23 and lower wedging draw block 22 as illustrated in FIG. 1.

Figure 12A:
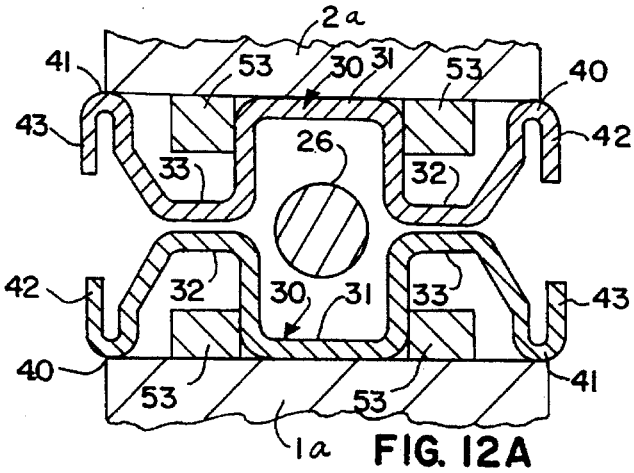
FIG. 12A is a cross-sectional view taken along the plane XIIA—XIIA of FIG. 12.
Figure 8:
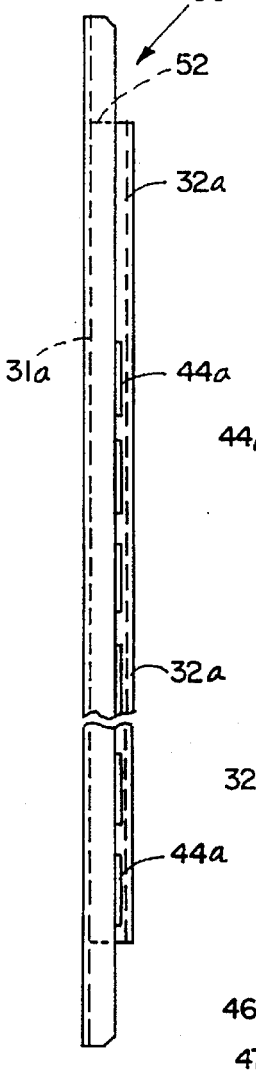
FIG. 8 is side-elevational view of a second embodiment of the hanger bracket/connector strip.
Figure 9:
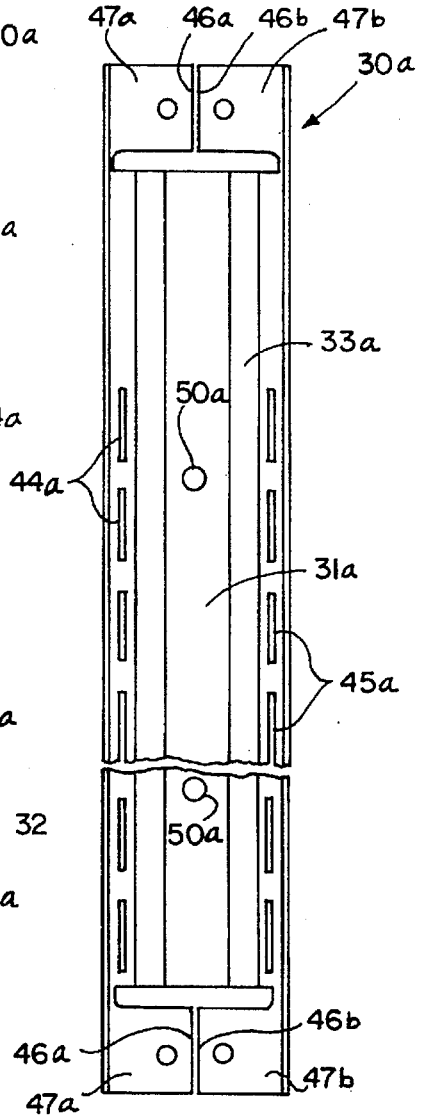
FIG. 9 is a plan view of the hanger bracket/connector strip of FIG. 8.
Figure 10:
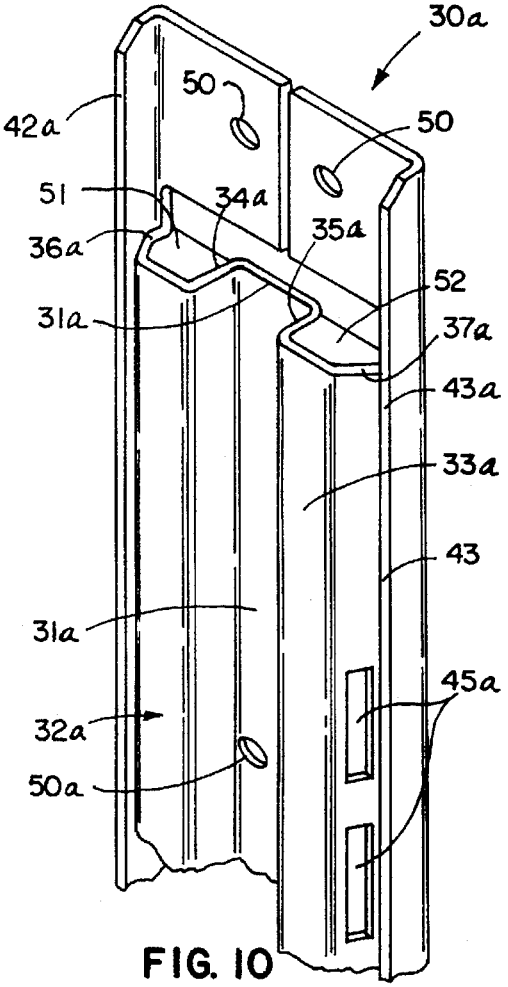
FIG. 10 is a perspective view of an end portion of the hanger bracket/connector strip of FIGS. 8 and 9.
Figure 12:
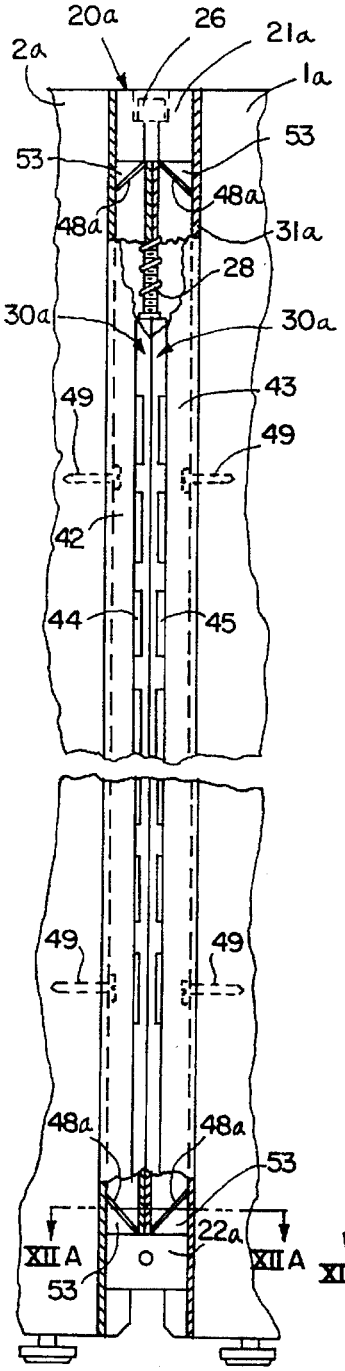
FIG. 12 is a side-elevational view of two panels connected together utilizing the hanger bracket/connector strip of FIGS. 8, 9, and 10 and wedge mating members like that disclosed in FIG. 11.

Referring to FIGS. 12 and 12A, hanger bracket/connector strips 30*a* are shown attached to the edges of panels 1*a* and 2*a* by screws 49. Located between the two strips 30*a* is the connector assembly 20*a* comprising the upper wedging draw block 21*a* and the lower wedging draw block 22*a*, each of which include the wedging elements 53 having wedging surfaces. Wedging elements 53 are wedged into the sockets 51 and 52 formed between the inner leg 34*a* and outer leg 36*a* and inner leg 35*a* and outer leg 37*a* (FIG. 10). The two wedging draw blocks 21*a* and 22*a* are drawn toward each other by the tie rod or bar 23*a* in the manner as described above in relation to FIGS. 1 and 5.

Figure 14A:
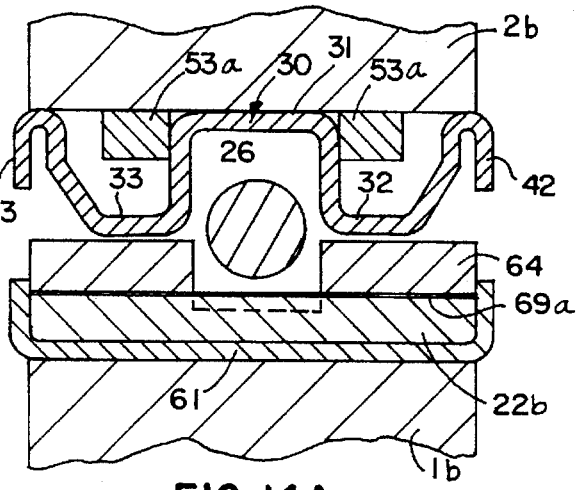
FIG. 14A is a cross-sectional view taken along the plane XIVA—XIVA of FIG. 14.
Figure 5B:
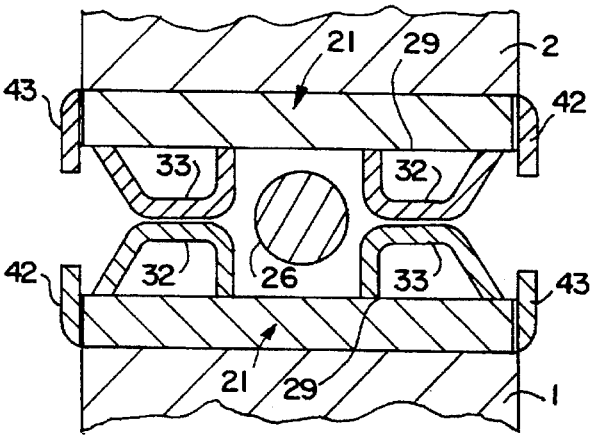
FIG. 5B is a cross-sectional view taken along the plane VB—VB of FIG. 5.
Figure 15A:
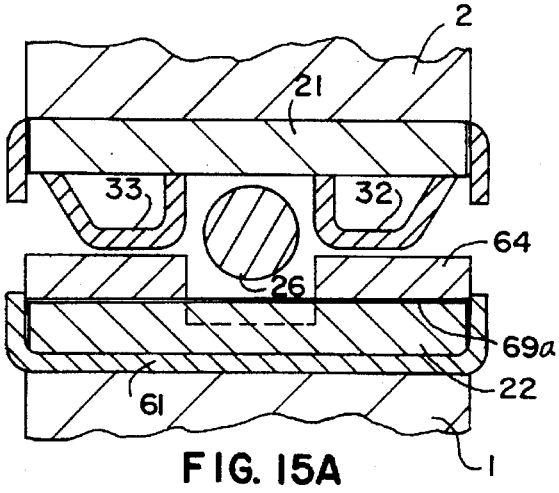
FIG. 15A is a cross-sectional view taken along the plane XVA—XVA of FIG. 15.
Figure 13:
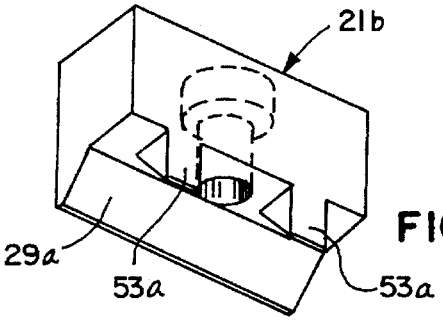
FIG. 13 is a perspective view of a wedge mating member designed to connect the edges of two panels together in which one panel utilizes the hanger bracket/connector strip of FIGS. 8, 9, and 10 and the other panel utilizes the hanger bracket and connector assembly as disclosed in U.S. Pat. No. 3,430,997.
Figure 14:
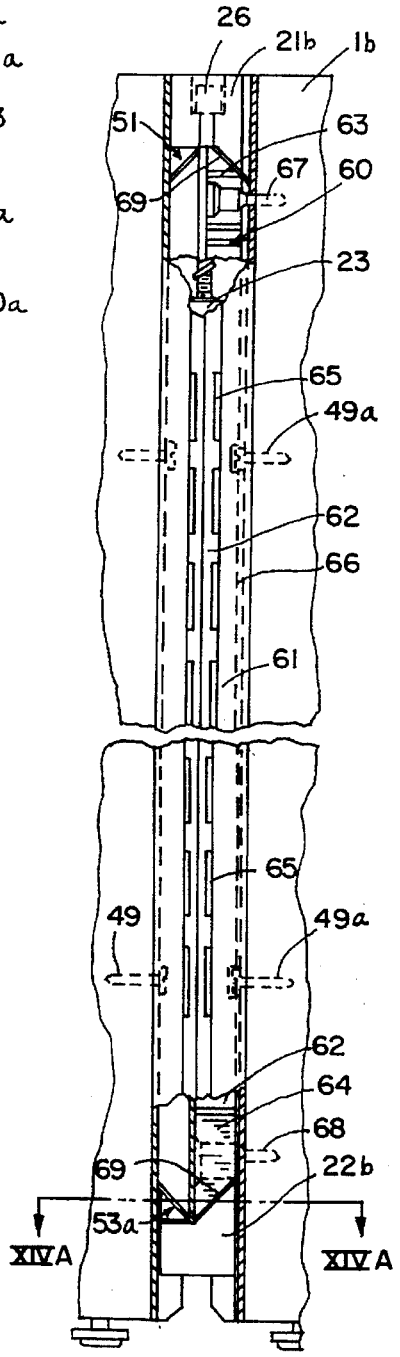
FIG. 14 is a side-elevational view of two panels connected together by the hanger bracket/connector strip of FIGS. 8, 9, and 10 and the connector and hanger bracket assembly of U.S. Pat. No. 3,430,997.
Figure 15:
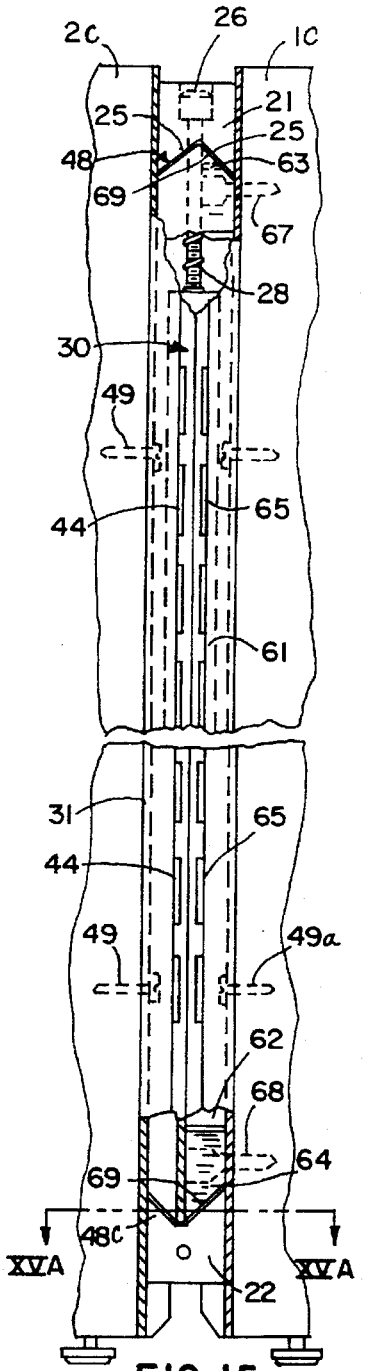
FIG. 15 is a side-elevational view of two panels connected together by a hanger bracket/connector strip of FIGS. 2, 3, and 4 and the connector and hanger bracket assembly of U.S. Pat. No. 3,430,997.

Having described the two embodiments of the hanger bracket/connector strips 30 and 30*a*, it may be necessary and/or desirable to join a panel which includes the strips 30 or 30*a* to an already existing panel which includes the interlock assembly as disclosed in U.S. Pat. No. 3,430,997. FIGS. 13–15 illustrate an arrangement for accommodating such a combination.

FIGS. 13 and 14 illustrate such structure in which the panels 1*b* and 2*b* are connected together by use of the hanger bracket/connector strip 30*a* and the connector assembly 60 of U.S. Pat. No. 3,430,997.

Figure 7:
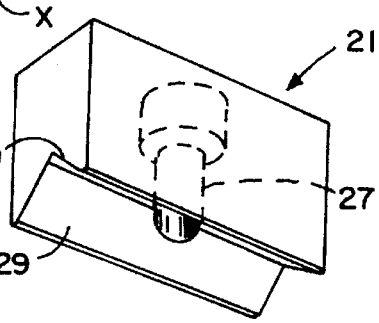
FIG. 7 is a perspective view of one of the wedge mating members disclosed in FIGS. 1 and 5.

FIG. 13 discloses a specially designed upper wedging draw block 21*b* in which the wedging surface 29*a* is the same as the wedging surface 29 of FIGS. 1 and 7. At the opposite side of the wedging draw block 21*b* is provided the spaced wedging elements 53*a* of the same configuration as the wedging elements 53 of FIG. 11. The wedging surface 29*a* is utilized to connect with the panel interlock assembly of U.S. Pat. No. 3,430,997 whereas the wedge elements 53*a* are utilized to interfit within the sockets 51 and 52.

The combination of the hanger bracket/connector strip 30*a* and the connector and hanger bracket assembly of U.S. Pat. No. 3,430,997 is illustrated in FIGS. 14 and 14A. The assembly 60 of U.S. Pat. No. 3,430,997 includes the U-shaped channel 61, the hanger bracket 62, the upper wedge block 63, and lower wedge block 64. The U-shaped channel 61 is secured to the edge of panel 1*b* and hanger bracket 62 which includes the slots 65 and is attached to the edge of panel 1*b* within the channel 61 by screws 49*a* extending through the central flat portion 66. Upper wedge block 63 is secured above bracket 62 within channel 61 to the edge of the panel 1*b* by the screws 67. Lower wedge block 64 is secured below bracket 62 also within channel 61 to the edge of panel 1*b* by screws 68. Thus, the connector and hanger bracket assembly 60 of U.S. Pat. No. 3,430,997 is comprised of four parts including the channel 61, the hanger bracket 62, and the wedge blocks 63 and 64, all as disclosed in U.S. Pat. No. 3,430,997, the disclosure of which is incorporated herein by reference.

In accordance with this invention, the hanger bracket/connector strip 30*a*, which has been previously described in relation to FIGS. 8, 9, 10 and 12 is mounted on the edge of panel 2*b* in the same manner as described in relation to FIG. 12. In this combination, the upper wedging draw block 21*b* is located above strip 30*a* and the wedge block 63, and a similarly shaped wedging draw block 22*b* is located below strip 30*a* and the wedge block 64. The two wedging draw blocks 21*a* and 22*b* are drawn toward each other by the tie rod or bar 23 which forces the wedging surfaces 29*a* of the draw blocks 21*b* and 22*b* against the inclined wedging surfaces 69 of the wedge blocks 63 and 64.

As the upper and lower wedging draw blocks 21*b* and 22*b* are drawn toward each other, the wedging elements 53*a* are drawn into the sockets 51 and 52, both at the lower and upper ends of the hanger bracket/connector strip 30*a*, all as explained in relation to FIG. 12.

FIG. 15 discloses a combination of the connector assembly 60 of U.S. Pat. No. 3,430,997 as previously described and the hanger bracket/connector strip 30. In this combination, the upper and lower wedging draw blocks 21 and 22 are utilized. Like that described in FIG. 14, the connector assembly 60 includes a channel-shaped member 61 attached to the edge of panel 1*c*. Also secured to the edge of panel 1*c* within the channel 67 is the hanger bracket 62, the upper wedge block 63, and the lower wedge block 64, all as described in relation to FIG. 14. Strip 30 is connected to the edge of panel 2*c* as previously described in relation to FIG. 5. In this combination, the upper wedging draw block 21 is mounted with the wedging surface located above the wedging surface 69 and located in socket 48 above the inclined surface of socket 48. Also, wedging draw block 22 is mounted below wedging surface 69*a* and located in socket 48*c* below the inclined surface of socket 48*c*. Thus, when the tie rod 23 is adjusted to draw the two upper and lower wedging draw blocks 21 and 22 toward each other, the wedging surfaces thereof contact to draw the edges of the panels 1*c* and 2*c* together.

It will be evident from the above description that the present invention conceived more than 27 years after the development of the hanger bracket/connector assembly of U.S. Pat. No. 3,430,997 has produced a remarkable result by providing in one piece that which over all the years has required four separate components that had to be manufactured separately and assembled separately on each of the edges of adjoining panels. Thus, in accordance with this invention, an unexpected and unusual result has been accomplished by this invention.

While a preferred embodiment of this invention has been illustrated in detail, it will be readily apparent to those skilled in the art that many other embodiments may be conceived and fabricated without departing from the spirit of this invention. Such embodiments are deemed as included within the scope of the following claims.

The embodiments of the invention in which an exclusive property or privilege is claimed are defined as follows:

1. A panel assembly including a hanger bracket/connector assembly for connecting the opposing edges of first and second panels together and for hanging accessories thereon comprising first and second hanger bracket/connector strips; said first strip for mounting on one of said opposing edges of said first panel and said second strip for mounting on the other edge of said second panel; said first and second strips each being one piece and in cross section taken laterally between the ends thereof including a flat central portion substantially located on a first plane and engaging and attached to the edge of one of said panels, each strip having U-shaped protruding bent portions on each side of said central portion integrally with and extending away from said flat central portion and said plane, said protruding bent portion each including an inner leg extending away from said flat central portion and said first plane, an outer leg spaced from said inner leg and extending toward said plane, said outer leg having longitudinally spaced slots for receiving hooks whereby accessories can be supported on said strip, said inner and outer legs being connected by a web; a reverse bent portion integral with said outer leg and flanges integral with said reverse bent portion, said flanges extending away from said panel on which said strip is attached and located substantially on parallel planes on each side of said outer legs; said strips having upper and lower ends with flat surfaces, said ends extending in a direction longitudinally away from said central portion and located on said first plane; said flanges extending along said flat surfaces and integral therewith; said protruding bent portions forming sockets at their upper and lower ends; upper and lower wedge mating members configured to fit into and mate with said sockets; an elongated tie bar adjustably interconnected between said upper and lower wedging members; and means for drawing at least one of said wedging members toward the other wedging member to force said wedging members into said sockets.

2. The panel assembly of claim 1 in which said sockets at the ends of said protruding bent portions at both their upper and lower ends are formed by a cut-out along a plane inclined toward the longitudinal center of said strip; and said upper and lower wedging members include inclined surfaces corresponding to the inclined angles of said cut-out.

3. The panel assembly of claim 1 in which said sockets at the protruding bent portions at both the upper and lower ends are formed by the spaces between the inner and outer legs of each of the protruding bent portions; and said upper and lower wedging members include spaced protruding wedging elements extending into the sockets formed between said inner and outer legs, said protruding wedging elements having inclined surfaces for drawing said edges of said panels toward each other as said wedging members are drawn toward each other by said elongated tie bar.

4. The panel assembly of claim 3 in which said hanger/bracket connector strips for each panel are identical and four of said wedging protrusions are provided, one for each of the sockets formed by said protruding bent portions.

5. A panel assembly including a hanger bracket/connector assembly for connecting the opposing edges of first and second panels together and for hanging accessories thereon comprising: a hanger bracket/connector strip for mounting on one of said opposing edges of said first panel; a panel connector means and a separate hanger bracket for mounting on said other edge of said second panel; said hanger bracket/connector strip being one piece and in cross section taken between the ends thereof including a flat central portion substantially located on a first plane and engaging and attached to the edge of said first panel, U-shaped protruding bent portions on each side of said central portion integral with and extending away from said flat central portion and said plane; said protruding bent portions each including an inner leg extending away from said flat central portion and said plane, an outer leg spaced from said inner leg and extending toward said first plane, said outer leg having longitudinal spaced slots for receiving hooks whereby accessories can be hung on said strip, said inner and outer legs being connected by a web; a reverse bent portion integral with said outer leg; second and third parallel flanges integral with said outer legs, said flanges extending away from and orthogonal to said first plane and located on each side of said outer legs; said strip having upper and lower ends with flat surfaces, said ends extending in a direction longitudinally from said flat central portion and located on said first plane; said flanges extending along said flat surfaces and integral therewith; said U-shaped protruding bent portions forming first upper and lower sockets at their upper and lower ends; upper and lower wedging members each having configured surfaces on one side adjacent said first panel to fit into and mate with said first upper and lower sockets; said panel connector means and separate hanger bracket including an elongated U-shaped channel, including a flat web attached to the edge of said second panel and having second parallel spaced flanges extending away from said flat web; a hanger bracket strip shorter than said first strip and attached to said edge of said second panel in said U-shaped channel between said second parallel spaced flanges whereby an upper space is located between the upper ends of said second strip and the upper end of said U-shaped channel and a lower space is located between the lower end of said second strip and the lower end of said channel; a separate upper wedging block attached to said channel in said upper space and a separate lower wedging block attached to said channel in said lower space; said upper and lower wedging blocks including second upper and lower sockets; said upper and lower wedging members each having surfaces configured on their sides adjacent said second panel to fit into and mate with said second upper and lower sockets; an elongated tie bar adjustable interconnected between said upper and lower wedging members; and means for drawing at least one of said wedging members toward the other wedging member to force said configured surfaces of said wedging members into said first and second upper and lower sockets.

6. The panel assembly of claim 5 in which said first upper and lower sockets at the ends of said protruding bent portions at both their upper and lower ends of said first hanger bracket/connector strip are formed by a cut-out along a plane inclined toward the longitudinal center of said strip; and said upper and lower wedging members include inclined surfaces corresponding to the inclined angles of said cut-out.

7. The panel assembly of claim 5 in which said first upper and lower sockets at the protruding bent portions at both the upper and lower ends of said first hanger bracket/connector strip are formed by the spaces between the inner and outer legs of each of the protruding bent portions; and said upper and lower wedging members include spaced protruding wedging elements extending into the sockets formed between said inner and outer legs, said protruding wedging elements having inclined surfaces for drawing said edges of said panels toward each other as said wedging members are drawn toward each other by said elongated tie bar.

8. A hanger bracket/connector strip for connecting the opposing edges of panels together and for hanging accessories thereon comprising:

a one-piece elongated formed strip of material which in cross section taken laterally between the ends thereof includes:

a flat central portion located on a first plane and having means for attachment to the edge of a panel;

U-shaped protruding bent portions on each side of said central portion integral with and extending away in the same direction from said flat central portion;

said protruding bent portions each including an inner leg connected to and extending from said first plane, a web connected to said inner leg and an outer leg connected to said web, said outer leg extending toward said plane and having longitudinally spaced slots for receiving hooks whereby accessories can be hung on said strip;

a reverse bent portion integral with said outer leg and flanges integral with said reverse bent portion and extending away from said plane, said flanges being located on parallel second and third planes on each side of said outer legs; and said strips having upper and lower ends with flat surfaces, said ends extending in a direction longitudinally from said central portion and located on said first plane; said flanges extending along said flat surfaces and integral therewith; said protruding bent portions forming sockets at their upper and lower ends.

9. The connector strip of claim 8 in which said sockets at the ends of the protruding bent portions at both their upper and lower ends are formed by a cut-out along a plane inclined toward the longitudinal center of said strip for engagement by a corresponding inclined surface of a wedging member.

10. The panel assembly of claim 1 in which said sockets at the protruding bent portions at both the upper and lower ends are formed by the spaces between the inner and outer legs of each of the protruding bent portions for receiving spaced wedging protrusions of a wedging member.

11. A hanger bracket/connector strip for connecting the opposing edges of panels together and for hanging accessories thereon comprising:

a one-piece elongated formed strip of material which in cross section taken laterally between the ends thereof includes:

a flat central portion located on a first plane and having means for attachment to the edge of a panel;

U-shaped protruding bent portions on each side of said central portion integral with and extending away in the same direction from said flat central portion;

said protruding bent portions each including an inner leg connected to said central portion and extending from said first plane, a web connected to said inner leg and an outer leg connected to said web, said outer leg extending toward said plane and having longitudinally spaced slots for receiving hooks whereby accessories can be hung on said strip; and a reverse bent portion integral with said outer leg and flanges integral with said reverse bent portion and extending away from said plane, said flanges being located on parallel planes on each side of said outer legs.

* * * * *